US011309622B2

(12) United States Patent
Isambard

(10) Patent No.: US 11,309,622 B2
(45) Date of Patent: Apr. 19, 2022

(54) APPARATUS FOR ATTACHING AN ORTHOGONAL MODE TRANSDUCER TO AN ANTENNA

(71) Applicant: Nokia Shanghai Bell Co., Ltd., Shanghai (CN)

(72) Inventor: Loic Isambard, Campbon (FR)

(73) Assignee: NOKIA SHANGHAI BELL CO., LTD., Shanghai (CN)

( * ) Notice: Subject to any disclaimer, the term of this patent is extended or adjusted under 35 U.S.C. 154(b) by 51 days.

(21) Appl. No.: 16/859,862

(22) Filed: Apr. 27, 2020

(65) Prior Publication Data

US 2020/0343622 A1 Oct. 29, 2020

(30) Foreign Application Priority Data

Apr. 29, 2019 (EP) ..... 19171577

(51) Int. Cl.
*H01Q 1/24* (2006.01)
*H01Q 1/12* (2006.01)

(52) U.S. Cl.
CPC ..... *H01Q 1/24* (2013.01); *H01Q 1/12* (2013.01); *H01Q 1/1207* (2013.01)

(58) Field of Classification Search
CPC ..... H01Q 1/24; H01Q 1/1207; H01Q 1/12; H01Q 1/00; H01P 1/042
USPC ..... 343/880
See application file for complete search history.

(56) References Cited

U.S. PATENT DOCUMENTS 5,568,160 A * 10/1996 Collins ..... H01Q 21/0087 343/778
5,760,749 A * 6/1998 Minowa ..... H01Q 13/00 343/772
6,937,203 B2 * 8/2005 Rao ..... H01Q 3/2658 333/125
9,680,194 B2 * 6/2017 Chong ..... H01P 11/001
2010/0141543 A1 * 6/2010 Parekh ..... H01Q 19/19 343/786
2012/0019424 A1 * 1/2012 Syed ..... H01Q 1/1228 343/756
2013/0278352 A1 * 10/2013 Mahon ..... H01P 1/161 333/137

(Continued)

FOREIGN PATENT DOCUMENTS

CN 101340016 A 1/2009
CN 201638479 U 11/2010

(Continued)

OTHER PUBLICATIONS

Office action received for corresponding Chinese Patent Application No. 202010352086.X, dated Dec. 23, 2020, 9 pages of office action and no page of translation available.
"Telecommunication", Mass Hi-Tech, Retrieved on Mar. 18, 2019, Webpage available at : http://www.masshitech.in/products.php?url=products&cateid=1.

(Continued)

*Primary Examiner* — Hai V Tran

(74) *Attorney, Agent, or Firm* — Mendelsohn Dunleavy, P.C.; Yuri Gruzdkov; Steve Mendelsohn

(57) ABSTRACT

Apparatus for attaching an orthogonal mode transducer, OMT, to an antenna, wherein said apparatus comprises a frame for receiving said OMT, and an antenna interface device for establishing a radio frequency, RF, signal connection between said OMT and said antenna, wherein said frame comprises a supporting surface for releasably attaching said antenna interface device to said frame.

14 Claims, 9 Drawing Sheets

(56) References Cited

U.S. PATENT DOCUMENTS

| | | | | |
|---|---|---|---|---|
| 2013/0342390 | A1* | 12/2013 | Cha | H01Q 19/195 342/352 |
| 2014/0028532 | A1* | 1/2014 | Ehrenberg | H01Q 1/1235 343/912 |
| 2014/0354375 | A1 | 12/2014 | Chong et al. | |

FOREIGN PATENT DOCUMENTS

| | | | |
|---|---|---|---|
| CN | 206349479 | U | 7/2017 |
| CN | 206441877 | U | 8/2017 |
| CN | 208299044 | U | 12/2018 |
| CN | 208460990 | U | 2/2019 |
| EP | 1191624 | A2 | 3/2002 |
| WO | 2010/123634 | A1 | 10/2010 |
| WO | 2014/197220 | A1 | 12/2014 |
| WO | 2015/185150 | A1 | 12/2015 |

OTHER PUBLICATIONS

Extended European Search Report received for corresponding European Patent Application No. 19171577.0, dated Oct. 24, 2019, 9 pages.

Office action received for corresponding Chinese Patent Application No. 202010352086.X, dated Aug. 17, 2021, 9 pages of office action and no page of translation available.

Office action received for corresponding European Patent Application No. 19171577.0, dated Sep. 15, 2021, 7 pages.

Third Office Action for corresponding Chinese application No. 202010352086.X; dated Feb. 8, 2022 (9 pages); Machine Translation.

Li, Yang, et al. "Design of a C-band Dual-beam Feed for Angular Diversity Antenna System." Chinese Journal of Radio Engineering, ISSN: 1003-3106 (Nov. 2015): 52-55. English Abstract.

* cited by examiner

APPARATUS FOR ATTACHING AN ORTHOGONAL MODE TRANSDUCER TO AN ANTENNA

CROSS-REFERENCE TO RELATED APPLICATION

This application claims the benefit of European patent application No. 19171577.0 filed on Apr. 29, 2019, titled "APPARATUS FOR ATTACHING AN ORTHOGONAL MODE TRANSDUCER TO AN ANTENNA", the content of which is incorporated herein by reference in its entirety.

FIELD OF THE INVENTION

Exemplary embodiments relate to an apparatus for attaching an orthogonal mode transducer, OMT, to an antenna. Further exemplary embodiments relate to a method of providing an apparatus for attaching an orthogonal mode transducer, OMT, to an antenna.

BACKGROUND

Orthogonal mode transducers, which may also be denoted as orthomode transducers, abbreviated as "OMT", may be used to combine two polarized (time varying) electrical fields or field components, respectively, e.g. H (horizontal plane) and V (vertical plane), i.e. two orthogonally polarized electric field components, of electromagnetic waves, e.g. microwaves. In view of this, an OMT may also be denoted as polarization duplexer. It may e.g. be used with an antenna, such as e.g. a microwave antenna, for example a parabolical microwave antenna. According to some aspects, an OMT may comprise machined parts assembled with accuracy.

SUMMARY

Exemplary embodiments relate to an apparatus for attaching an orthogonal mode transducer, OMT, to an antenna, wherein said apparatus comprises a frame for receiving said OMT, and an antenna interface device for establishing a radio frequency, RF, signal connection between said OMT and said antenna, wherein said frame comprises a supporting surface for releasably attaching said antenna interface device to said frame. This way, the apparatus may be attached to an antenna, e.g. a parabolic microwave antenna, and external mechanical forces transmitted from the antenna to the apparatus and/or resulting from the mounting of the apparatus to the antenna may be directed into the frame via the antenna interface device, so that the OMT is not exposed to and/or affected by such forces or mechanical stress related thereto. This further enables to provide a design of the OMT which is optimized regarding its function of combining radio frequency signals and which can be weight-optimized.

According to further exemplary embodiments, said frame comprises a fastening device for releasably attaching said frame to said antenna.

According to further exemplary embodiments, said fastening device comprises at least two fastening sections, wherein at least one of said two fastening sections comprises an elastically deformable zone. This enables to temporarily deform said elastically deformable zone thus providing a restoring force to the frame or e.g. the antenna interface device, by means of which said antenna interface device may be pressed against an interface section of the antenna in a controlled manner.

According to further exemplary embodiments, said at least two fastening sections are arranged radially outside with respect to said supporting surface and/or are at least partly surrounding said supporting surface.

According to further exemplary embodiments, at least one of said at least two fastening sections comprises a basically planar end section, wherein at least one oblong hole is provided in said basically planar end section. This enables to securely fasten said at least two fastening sections to the antenna, wherein a compensation of mechanical tolerances of the involved components is enabled by the oblong holes. According to further exemplary embodiments, at least one of said oblong holes extends in a substantially circumferential direction. Thus, a rotational adjustment between the frame and the antenna is enabled which e.g. enables fine tuning of the polarizations H, V.

According to further exemplary embodiments, at least one of said two fastening sections comprises C-shape, which enables to define said elastically deformable zones and to direct a force flow in the section of the frame where said fastening device is provided.

According to further exemplary embodiments, a waveguide is provided for connecting said antenna interface device with said OMT. This enables to guide radio frequency signals from the antenna interface device to the OMT ("receive direction") and vice versa ("transmit direction"), enabling a spatial separation of the OMT from the antenna interface device. Preferably, said waveguide may be a hollow waveguide, i.e. a hollow cylindrical waveguide.

According to further exemplary embodiments, said waveguide is sealingly connected with said antenna interface device and said OMT. I.e., the mechanical connections between said waveguide and said OMT and/or between said waveguide and said antenna interface device is sealed such that particles cannot enter the components (waveguide and/or OMT and/or antenna interface device). According to further exemplary embodiments, sealing may be effected by providing a sealing ring, e.g. an O-ring, between two adjacent components. According to further exemplary embodiments, sealing may also be effected by providing a, preferably continuous, bed of glue between said two adjacent components.

According to further exemplary embodiments, said waveguide is mechanically connected with said antenna interface device and said OMT forming a monolithic OMT subassembly.

According to further exemplary embodiments, the antenna interface device comprises a cylindrical body and a flange section extending radially from said body, wherein said flange section comprises a plurality of holes. This enables to efficiently secure said antenna interface device at said supporting surface of the frame, e.g. by means of screws.

According to further exemplary embodiments, said flange section comprises a convex cylindrical surface, optionally a conical shape. This enables to align said flange section and the antenna interface device with a corresponding interface surface of the frame, e.g. in the region of the supporting surface. According to further exemplary embodiments, said frame may comprise a concave cylindrical surface for alignment with said convex cylindrical surface of said flange section.

According to further exemplary embodiments, the supporting surface comprises a plurality of threaded holes, so that said antenna interface device may efficiently and releasably be secured to said frame. This way, the frame may exert a mounting force to the antenna interface device which presses the antenna interface device to a corresponding interface surface of the antenna, wherein, according to further exemplary embodiments, said mounting force may e.g. provided by the elastically deformable zones of the fastening sections as mentioned above.

According to further exemplary embodiments, said OMT comprises at least one flange section for releasably attaching said OMT to said frame, e.g. by means of screws, wherein said at least one flange section preferably comprises at least one oblong hole which enables to compensate tolerances of the involved components (OMT, frame).

According to further exemplary embodiments, said frame comprises a receiving section for releasably attaching said OMT to said frame, wherein preferably said receiving section comprises a plurality of threaded holes.

According to further exemplary embodiments, said supporting surface is arranged in a first axial end section of said frame, and said receiving section is arranged in a second axial end section of said frame, which is opposite to said first axial end section.

Further exemplary embodiments relate to a method of providing an apparatus for attaching an orthogonal mode transducer, OMT, to an antenna, wherein said apparatus comprises a frame for receiving said OMT, and an antenna interface device for establishing a radio frequency, RF, signal connection between said OMT and said antenna, wherein said frame comprises a supporting surface for releasably attaching said antenna interface device to said frame, said method comprising: providing said antenna interface device, releasably attaching said antenna interface device to said frame, and, optional, releasably attaching said OMT to said antenna interface device.

According to further exemplary embodiments, said method further comprises: providing a monolithic OMT sub-assembly comprising said antenna interface device, said OMT, and optionally a waveguide connecting said antenna interface device with said OMT (according to further embodiments, a waveguide is not provided, and the OMT is directly attached to the antenna interface device), attaching said antenna interface device to said supporting surface of said frame, and, optionally, attaching said OMT to said frame.

BRIEF DESCRIPTION OF THE FIGURES

Some exemplary embodiments will now be described with reference to the accompanying drawings, in which.

DESCRIPTION OF THE EMBODIMENTS

Figure 1:
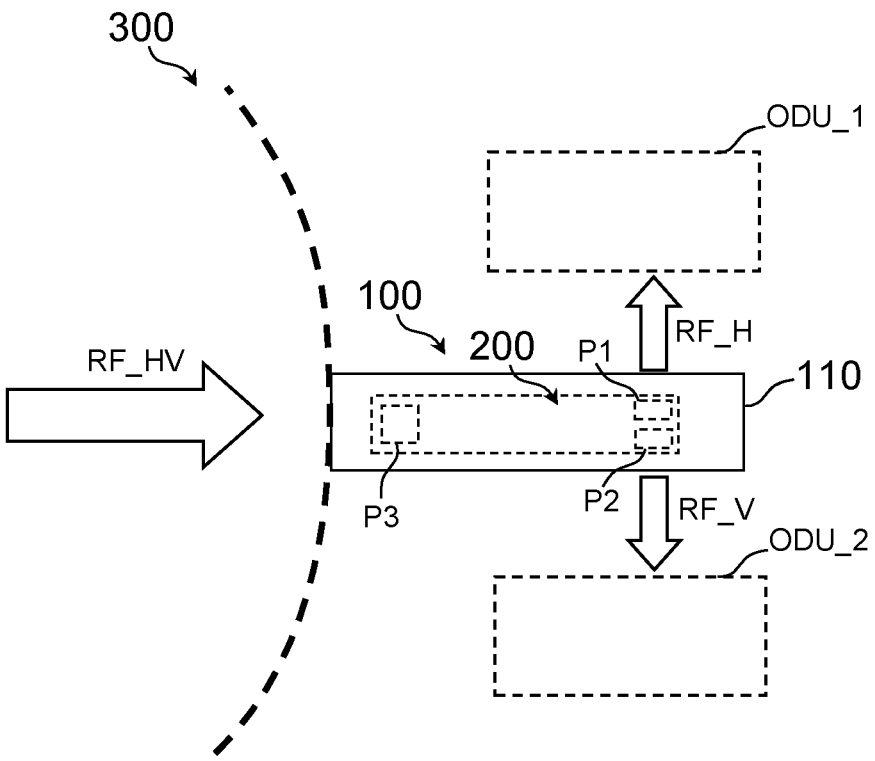
FIG. 1 schematically depicts a side view of an apparatus according to exemplary embodiments, FIG. 2 schematically depicts a more detailed side view of the apparatus according to further exemplary embodiments, FIG. 3A schematically depicts a perspective view of an antenna interface device according to further exemplary embodiments, FIG. 3B schematically depicts a perspective view of an antenna interface device according further exemplary embodiments, FIG. 4A schematically depicts a perspective view of an OMT sub-assembly in a first state according to further exemplary embodiments, FIG. 4B schematically depicts a perspective view of the OMT sub-assembly of FIG. 4A in a second state according to further exemplary embodiments, FIG. 5 schematically depicts a perspective detail view of the OMT of FIG. 4A, 4B, FIG. 6A schematically depicts a perspective view of an apparatus according to further exemplary embodiments, FIG. 6B schematically depicts a further perspective view of the apparatus of FIG. 6A, FIG. 6C schematically depicts a detail view of FIG. 6B, FIG. 7A schematically depicts a simplified flow-chart of a method according to further exemplary embodiments, FIG. 7B schematically depicts a simplified flow-chart of a method according to further exemplary embodiments, FIG. 8A schematically depicts a perspective view of an apparatus according to further exemplary embodiments, FIG. 8B schematically depicts a further perspective view of the apparatus of FIG. 8A, FIG. 8C schematically depicts a further perspective view of the apparatus of FIG. 8A, FIG. 9A schematically depicts a perspective view of an antenna for use with the apparatus according to further exemplary embodiments, FIG. 9B schematically depicts a detail view of FIG. 9A, FIG. 10 schematically depicts a perspective view of an antenna attached to an apparatus according to further exemplary embodiments, FIG. 11 schematically depicts a side view of a detail of FIG. 10 in partial cross-section, FIG. 12 schematically depicts a perspective view of an antenna mounted to an apparatus according to further exemplary embodiments, and FIG. 13 schematically depicts a simplified side view of a frame according to further exemplary embodiments.

FIG. 1 schematically depicts a side view of an apparatus 100 according to exemplary embodiments. Said apparatus 100 may be used for attaching an orthogonal mode transducer, OMT 200, to an antenna 300. The OMT 200 may be used to combine and/or separate two polarized (time varying) electrical fields or field components, respectively, e.g. H (horizontal plane) and V (vertical plane), i.e. two orthogonally polarized electric field components, of electromagnetic waves, e.g. microwaves. As an example, antenna 300 may be a parabolic antenna configured to transmit and/or receive electromagnetic waves, for example microwaves, comprising two orthogonally polarized electromagnetic field components. Block arrow RF_HV of FIG. 1 exemplarily depicts microwave radiation that may be received by said antenna 300, which radiation may comprise both a horizontal ("H") and a vertical ("V") polarization component. In other words, signal RF_HV may represent circularly polarized microwave radiation.

Upon receipt by the antenna 300, the incident microwave radiation RF_HV is transmitted to the OMT 200, which separates the two polarization components H, V from each other, provides the horizontal polarization component RF_H at a first port P1 to a first radio device ODU_1, and provides the vertical polarization component RF_V at a second port P2 to a second radio device ODU_2. The radio devices ODU_1, ODU_2 may in some embodiments also be denoted as "outdoor units". While the above example is related to a receive direction, in which the OMT 200 separates circularly polarized microwaves into individual H-/V-polarized components RF_H, RF_V, due to reciprocity, the OMT 200 may also be used in a transmit direction to receive respective H-/V-polarization components from said radio devices ODU_1, ODU_2 (at said first and second port, as mentioned above) and may combine them into a cross-polarized signal for transmission via the antenna 300.

As mentioned above, the OMT 200 may comprise the first port P1 representing an interface to exchange microwave radiation with the first radio device ODU_1 and the second port P2 representing an interface to exchange microwave radiation with the second radio device ODU_2. Additionally, the OMT 200 may comprise a third port P3 for exchanging microwave radiation with said antenna 300.

From a mechanical point of view, according to further exemplary embodiments, the apparatus 100 may be used to attach and/or mount said OMT 200 at/to the antenna 300. According to further exemplary embodiments, the radio devices ODU_1, ODU_2 may be attached to said apparatus 100, e.g. for interfacing the ports P1, P2.

Figure 2:
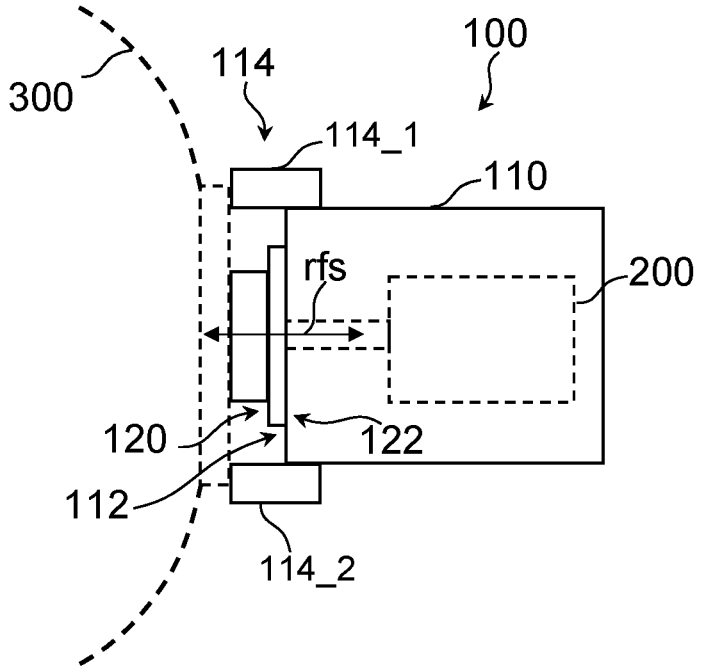

According to further exemplary embodiments, also cf. the more detailed view of FIG. 2, said apparatus 100 comprises a frame 110 for receiving said OMT 200, and an antenna interface device 120 for establishing a radio frequency, RF, signal connection rfs between said OMT 200 (e.g., via the third port P3, cf. FIG. 1) and said antenna 300. Advantageously, said frame 110 comprises a supporting surface 112 (FIG. 2) for releasably attaching said antenna interface device 120 to said frame 110. This way, the apparatus 100 may be attached to an antenna, e.g. the parabolic microwave antenna 300, and external forces transmitted from the antenna 300 to the apparatus 100 and/or resulting from the mounting of the apparatus 100 to the antenna 300 may be directed into the frame 110 via the antenna interface device 120, so that the OMT 200 is not exposed to such external forces. This further enables to provide a design of the OMT 200 which is optimized regarding its function of processing radio frequency signals and which can be weight-optimized.

According to further exemplary embodiments, said frame 110 comprises a fastening device 114 for releasably attaching said frame 110 to said antenna 300. Advantageously, said fastening device 114 is different from said antenna interface device 120.

According to further exemplary embodiments, said fastening device 114 comprises at least two fastening sections 114_1, 114_2, wherein at least one of said two fastening sections 114_1, 114_2 comprises an elastically deformable zone (not shown in FIG. 2, explained in detail further below with reference to FIG. 6A). This enables to temporarily deform said elastically deformable zone thus providing a restoring force to the frame 110 or e.g. the antenna interface device 120, e.g. a front surface 122 of the antenna interface device 120, by means of which said antenna interface device 120 may be pressed against an interface section of the antenna 300 in a controlled manner.

According to further exemplary embodiments, said at least two fastening sections 114_1, 114_2 are arranged radially outside with respect to said supporting surface 112 and/or are at least partly surrounding said supporting surface 112, which enables to provide a stable mechanical connection between the antenna 300 and the frame 110 and leaves installation space for the antenna interface device 120 in a radially inner region.

Figure 3A:
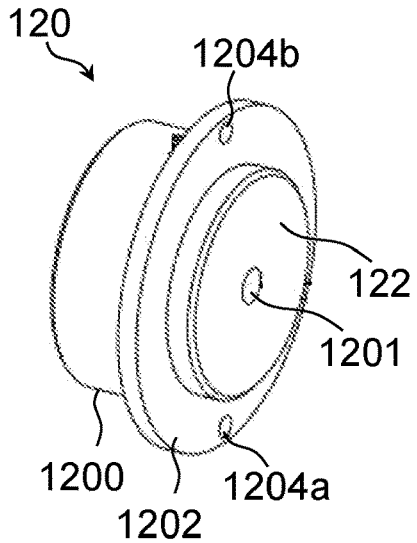
Figure 3B:
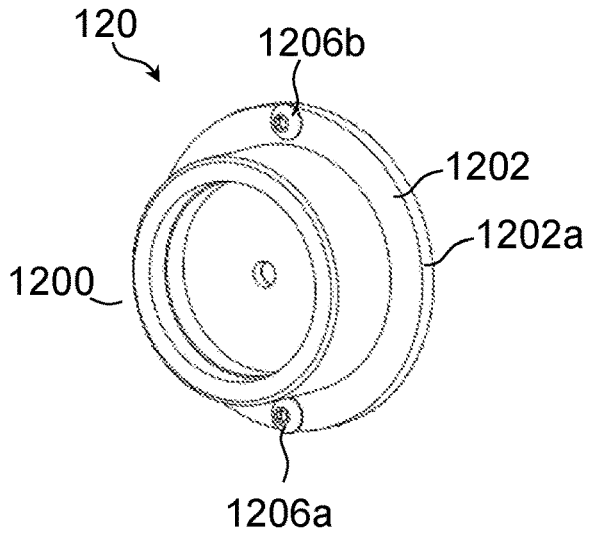

FIG. 3A, 3B each schematically depicts a perspective view of an antenna interface device 120 according to further exemplary embodiments. The antenna interface device 120 comprises a cylindrical body 1200 and a flange section 1202 extending radially from said body 1200, wherein said flange section 1202 comprises a plurality of (presently for example two) holes 1204*a*, 1204*b*. This enables to efficiently secure said antenna interface device 120 at said supporting surface 112 (FIG. 2) of the frame 110, e.g. by means of screws.

According to further exemplary embodiments, said flange section 1202 comprises a convex cylindrical surface 1202*a*, optionally with a conical shape. This enables to align, particularly to center, said flange section 1202 and the antenna interface device 120 with a corresponding interface surface 1120 (FIG. 6C) of the frame 110, e.g. in the region of the supporting surface 112. According to further exemplary embodiments, said frame 110 may comprise a concave (and optionally conical) cylindrical surface 1120 (FIG. 6C) for alignment with said convex cylindrical (optionally conical) surface 1202*a* of said flange section 1202.

According to further exemplary embodiments, the supporting surface 112 (FIG. 2, FIG. 6B) comprises a plurality of threaded holes 112*a*, so that said antenna interface device 120 may efficiently and releasably be secured to said frame 110 using the holes 1204*a*, 1204*b* (FIG. 3A) and screws 1206*a*, 1206*b* (FIG. 3B) inserted in said holes 1204*a*, 1204*b*. This way, when fastening the frame 110 to the antenna 300, by means of the fastening device 114, the frame 110 may exert a mounting force to the antenna interface device 120 (via the fastening sections 114_1, 114_2) which presses the antenna interface device 120 to a corresponding interface surface of the antenna 300. Said mounting force may e.g. provided by elastically deformable zones of the fastening sections as mentioned above.

According to further exemplary embodiments, in a radially inner region, the body 1200 of the antenna interface device 120 may comprise a, preferably circular, opening 1201 enabling an exchange of microwave radiation between the antenna 300 (FIG. 2) and the OMT 200 or an optional waveguide 116, cf. FIG. 4A, 4B explained in detail below, which may be arranged between said antenna interface device 120 and said OMT 200.

Figure 4A:
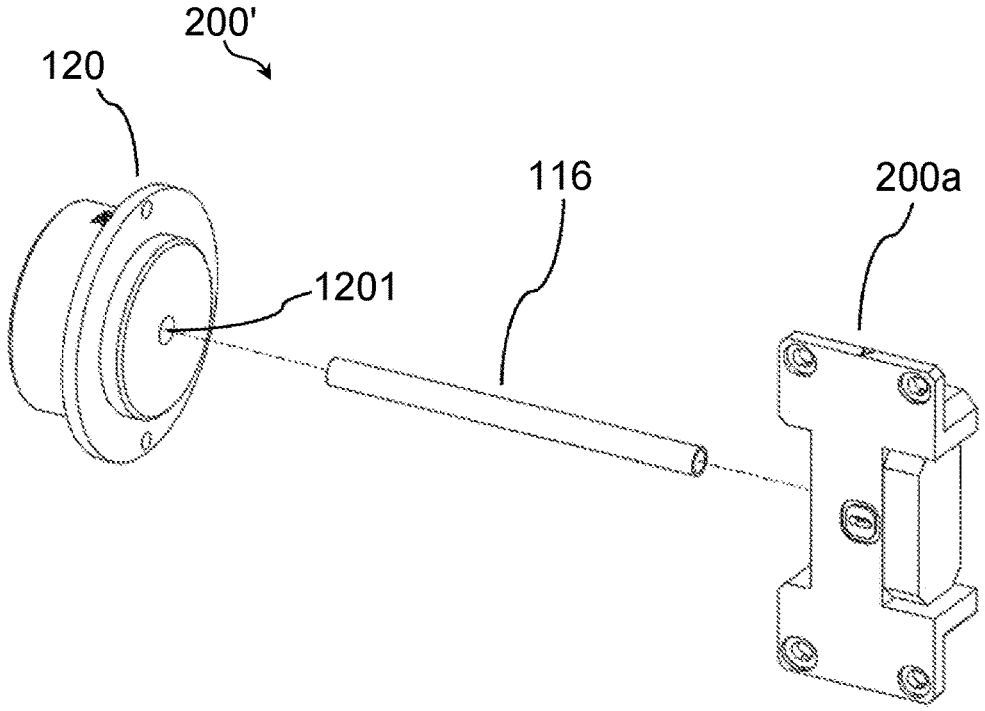
Figure 4B:
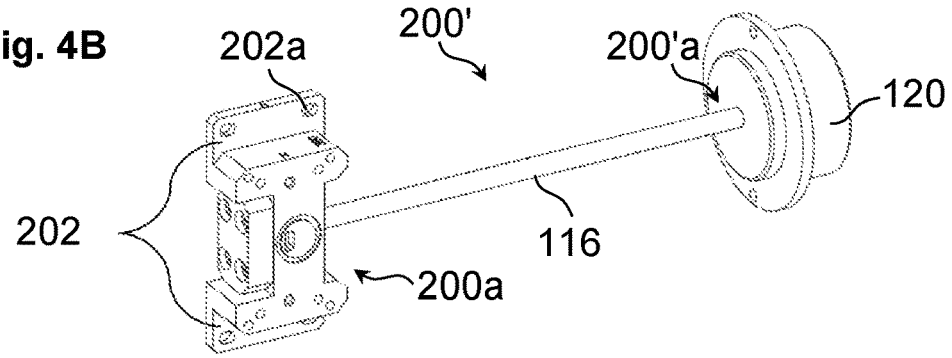

FIG. 4A schematically depicts a perspective view of an OMT sub-assembly 200' according to further exemplary embodiments in a first (disassembled) state, and FIG. 4B schematically depicts said OMT sub-assembly 200' in a second (assembled) state.

As mentioned above, according to further exemplary embodiments, a waveguide 116 may be provided for connecting said antenna interface device 120 with said OMT 200*a*. This enables to guide radio frequency signals from the antenna interface device 120 to the OMT 200*a* ("receive direction") and vice versa ("transmit direction"). Preferably, said waveguide 116 may be a hollow waveguide, i.e. a hollow cylindrical waveguide.

According to further exemplary embodiments, in the assembled state, cf. FIG. 4B, said waveguide 116 is sealingly connected with said antenna interface device 120 and said OMT 200*a*. I.e., the mechanical connections between said waveguide 116 and said OMT 200*a* and/or between said waveguide 116 and said antenna interface device 120 is sealed such that particles (dust, dirt, . . . ) and/or a surrounding medium (e.g., air) cannot enter the interior of the components (waveguide 116 and/or OMT 200*a* and/or antenna interface device). According to further exemplary embodiments, the sealing may be effected by providing a sealing ring (not shown), e.g. an O-ring, between two adjacent components 116, 120; 116, 200*a* (cf. exemplary reference sign 200'*a* of FIG. 4B). According to further exemplary embodiments, sealing may also be effected by providing a, preferably continuous, bed of glue (not shown) between said two adjacent components 116, 120; 116, 200*a*. According to further exemplary embodiments, said waveguide 116 is mechanically connected (sealingly, as mentioned above, or, according to further exemplary embodiments, not sealingly) with said antenna interface device 120 and said OMT 200*a* forming a monolithic OMT sub-assembly 200' that can be efficiently handled as one single part 200', which e.g. facilitates mounting of said OMT sub-assembly 200' at the frame 110 (FIG. 2).

According to further exemplary embodiments, said OMT 200*a* (FIG. 4B) comprises at least one flange section 202 (presently for example two flange sections 202) for releasably attaching said OMT 200*a* to said frame 110 (FIG. 2), e.g. by means of screws, wherein said at least one flange section 202 preferably comprises at least one oblong hole 202*a* which enables to compensate tolerances of the involved components (OMT 200*a*, frame 110) during mounting.

Figure 5:
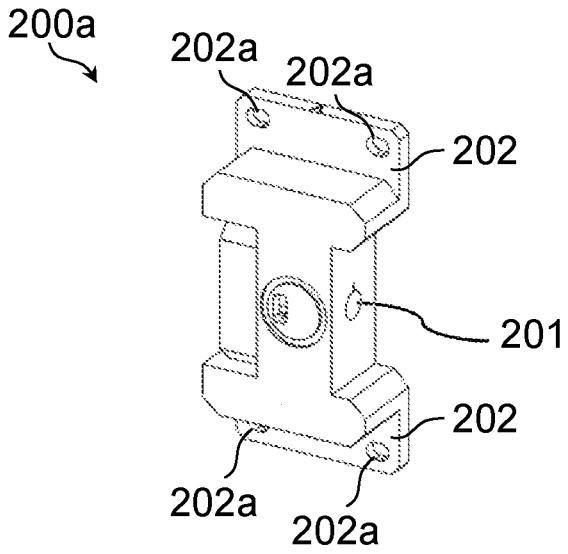

FIG. 5 schematically depicts a perspective detail view of the OMT 200*a* of FIG. 4A, 4B. Each flange section 202 comprises two oblong holes 202*a*. Also depicted is a circular opening 201 which may represent the third port P3 (also cf. the schematic side view of FIG. 1) for establishing a radio frequency signal connection rfs either with said antenna 300 or, according to further exemplary embodiments, with said waveguide 116, also cf. sealing section 200'*a* of FIG. 4B.

Figure 6A:
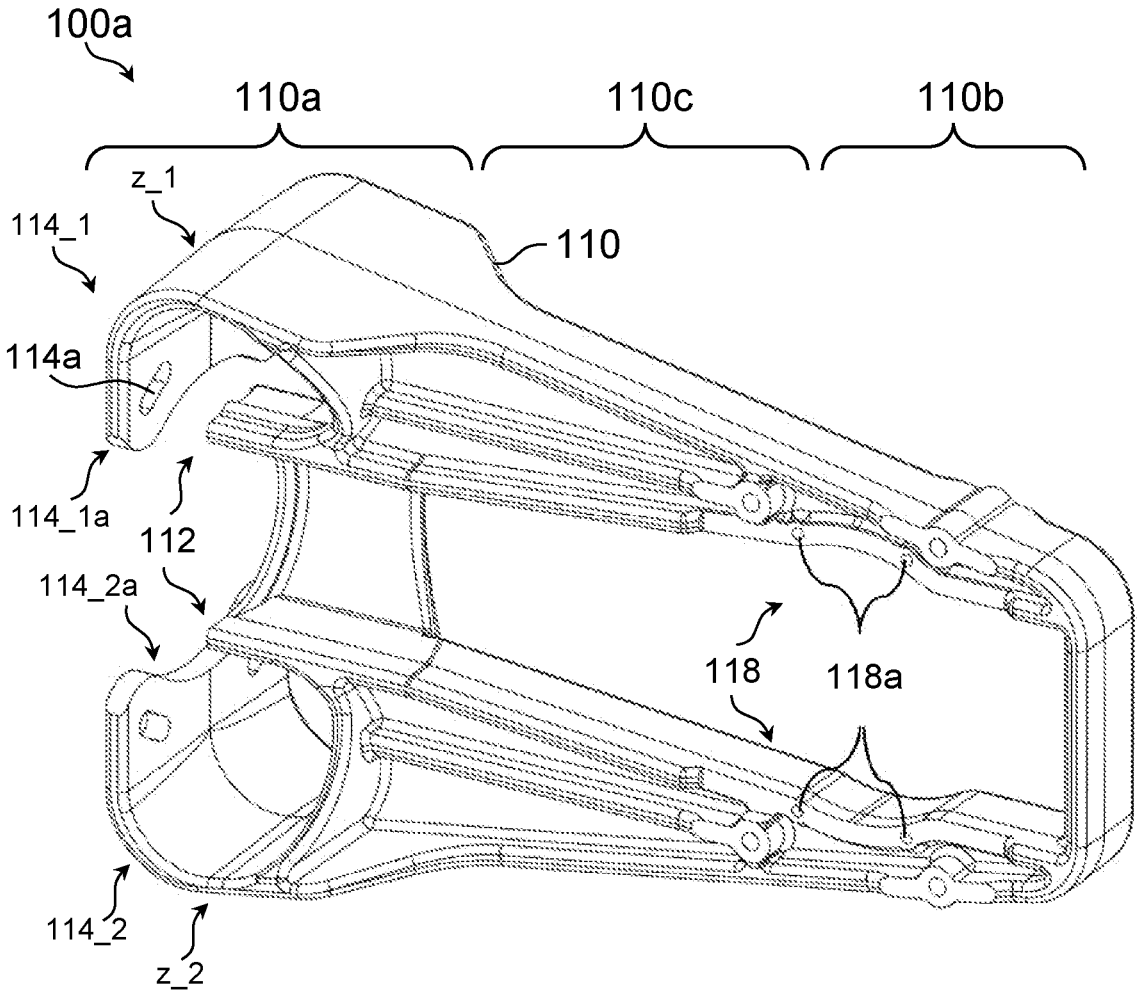
Figure 6B:
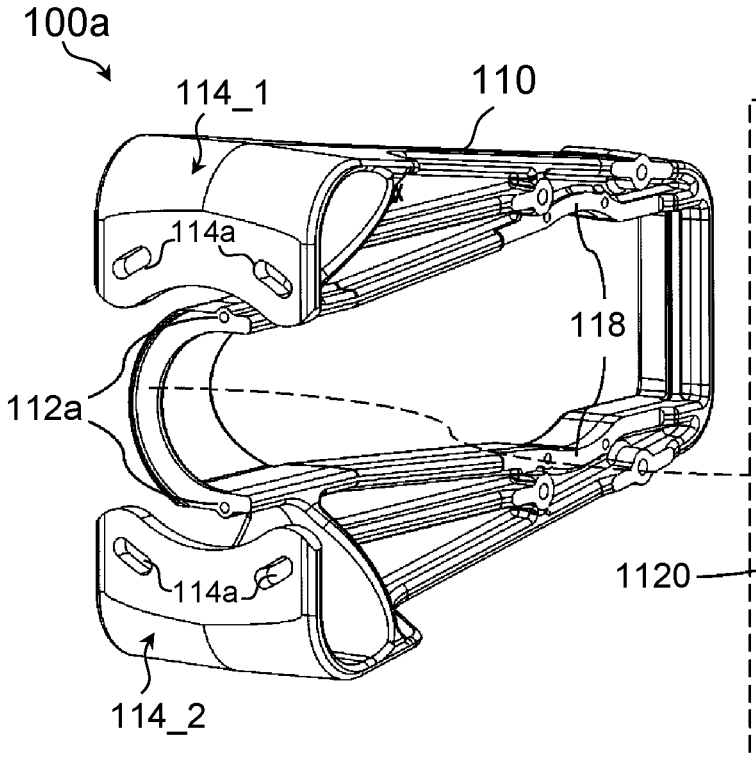
Figure 6C:
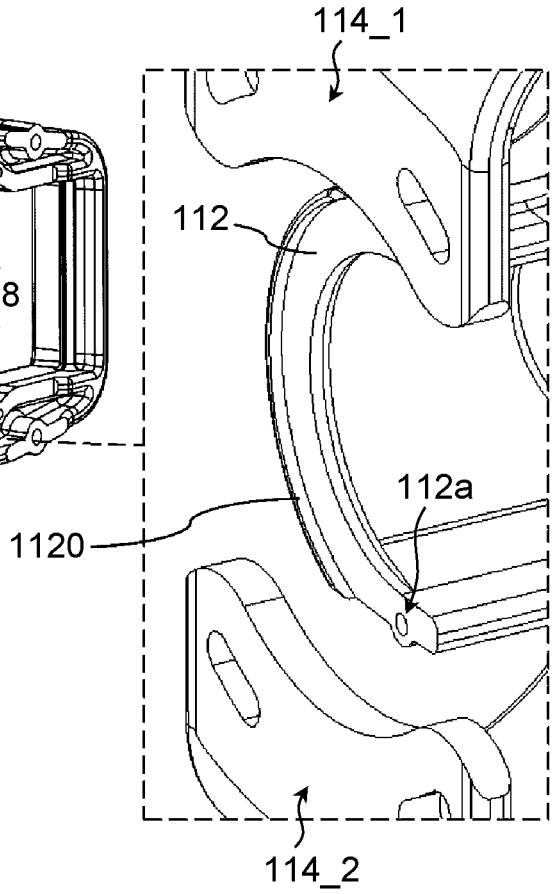

FIG. 6A schematically depicts a perspective view of an apparatus 100*a* according to further exemplary embodiments, FIG. 6B schematically depicts a further perspective view of the apparatus 100*a* of FIG. 6A, and FIG. 6C schematically depicts a detail view of FIG. 6B.

According to further exemplary embodiments, and as can be seen from FIG. 6, at least one of said at least two (presently exemplary both) fastening sections 114_1, 114_2 comprise(s) a basically planar end section 114_1*a*, 114_2*a*, wherein at least one oblong hole 114*a* is provided in said basically planar end section 114_1*a*, 114_2*a*. This enables to securely fasten said at least two fastening sections 114_1, 114_2 to the antenna 300, wherein a compensation of mechanical tolerances of the involved components 114, 300 is enabled by the oblong holes 114*a*. According to further exemplary embodiments, at least one of said oblong holes 114*a* extends in a substantially circumferential direction, cf. FIG. 6B. Thus, a rotational adjustment between the frame 110 and the antenna 300 is enabled which e.g. enables fine tuning of the polarizations H, V. This way, it can be ensured that e.g. the first radio device ODU_1 (FIG. 1) receives a maximum signal power related to a horizontally polarized component of received microwave radiation, and a minimum signal power related to a vertically polarized component of said received microwave radiation. Similar observations apply to the second radio device ODU_2 with respect to the vertically polarized radiation component.

According to further exemplary embodiments, at least one of said two fastening sections 114_1, 114_2 (FIG. 6A) comprises C-shape, which enables to define said elastically deformable zones z_1, z_2 and to direct a force flow in the section 110*a* of the frame 110 where said fastening device 114 is provided. This way, a flow of mounting forces between the frame 110 and the antenna interface device 120 and the antenna 300 may particularly be prevented from entering the receiving section 118 in which said OMT 200*a* may be mounted to the frame 110. This way, the design focus of the OMT 200*a* may be put on its RF signal processing function, and not on its mechanical stability, which enables to save material for the OMT 200*a* and to ensure a proper RF signal processing by said OMT 200*a*.

According to further exemplary embodiments, said receiving section 118 (FIG. 6A) of the frame 110 comprises a plurality of threaded holes 118*a* enabling to attach the OMT 200*a* (FIG. 5) with presently e.g. four screws through said oblong holes 202*a* to said frame 110 in the receiving section 118.

According to further exemplary embodiments, the supporting surface 112 (FIG. 6A) for receiving the antenna interface device 120 is arranged in a first axial end section 110*a* of said frame 110, and said receiving section 118 is arranged in a second axial end section 110*b* of said frame, which is opposite to said first axial end section 110*a*. In the intermediate axial section 110*c*, e.g. the optional waveguide 116 (FIG. 4B) may be placed.

As already mentioned above, the frame 110 may comprise an interface surface 1120 (FIG. 6C) which enables to center and/or align the antenna interface device 120 with its convex cylindrical surface 1202*a* for proper attachment of said antenna interface device 120 at said frame 110. As an example, according to further embodiments, proper alignment between components 110, 120 may be attained if the front surface 122 (FIG. 2) of the antenna interface device 120 is placed on said supporting surface 112 of the frame, and if surfaces 1202*a*, 1120 make contact with each other.

Figure 7A:
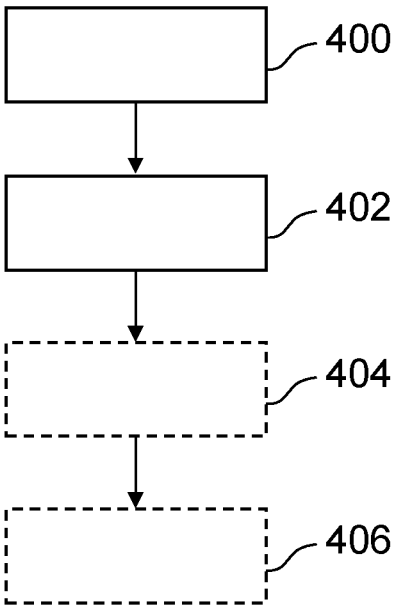

Further exemplary embodiments, cf. the flow chart of FIG. 7A, relate to a method of providing an apparatus 100, 100*a* for attaching an orthogonal mode transducer, OMT, 200, 200*a* to an antenna 300, wherein said apparatus 100, 100*a* comprises a frame 110 for receiving said OMT 200, 200*a*, and an antenna interface device 120 for establishing a radio frequency, RF, signal connection rfs between said OMT 200, 200*a* and said antenna 300, wherein said frame 110 comprises a supporting surface 112 for releasably attaching said antenna interface device 120 to said frame 110, said method comprising: providing 400 said antenna interface device 120 (e.g., as a lathe part manufactured from a material such as e.g. aluminum or an aluminum alloy, optionally coated with an(other) electrically conductive material), releasably attaching 402 said antenna interface device 120 to said frame 110 (e.g. by means of screws 1206*a*, 1206*b*, cf. FIG. 3B), and, optional, releasably attaching 404 said OMT 200*a* to said antenna interface device 120, e.g. directly, or, preferably, by means of said waveguide 116 (FIG. 4B).

Figure 7B:
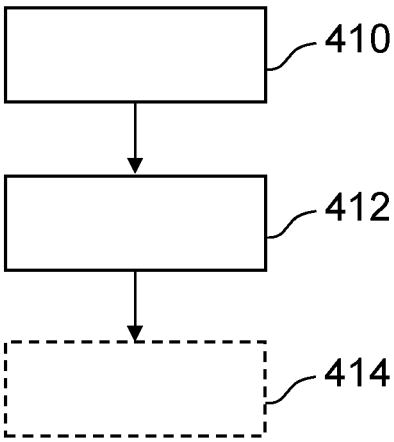

According to further exemplary embodiments, cf. the optional step 406 of FIG. 7A, the OMT 200*a* may be releasably attached to said frame 110, e.g. by means of screws, applied to the holes 202*a* of the OMT 200*a* and to the threaded holes 118*a* of the receiving section 118. According to further exemplary embodiments. cf. FIG. 7B, said method further comprises: providing 410 a monolithic OMT sub-assembly 200' (FIG. 4B) comprising said antenna interface device 120, said OMT 200*a*, and optionally a waveguide 116 connecting said antenna interface device 120 with said OMT 200*a* (according to further embodiments, a waveguide 116 is not provided, and the OMT 200*a* is directly attached to the antenna interface device 120), attaching 412 (FIG. 7B) said antenna interface device 120 to said supporting surface 112 of said frame 110, 110*a*, and, optionally, attaching 414 said OMT 200*a* to said frame 110, 110*a*.

Figure 8A:
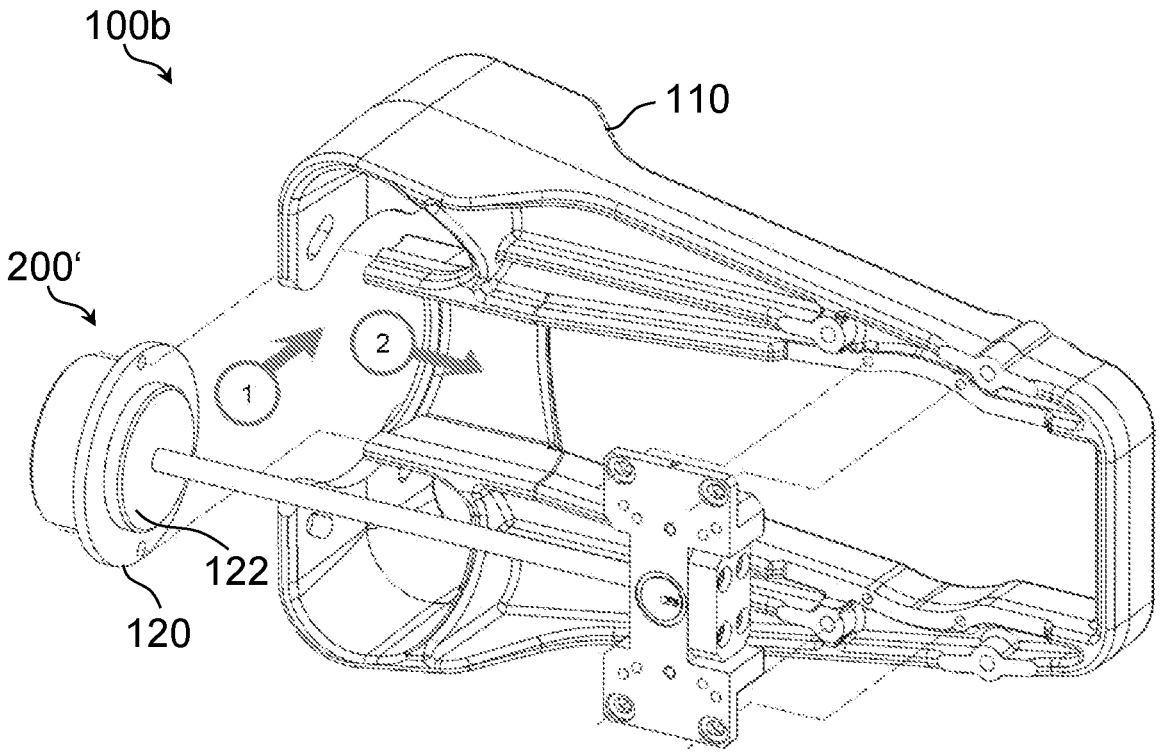
Figure 8B:
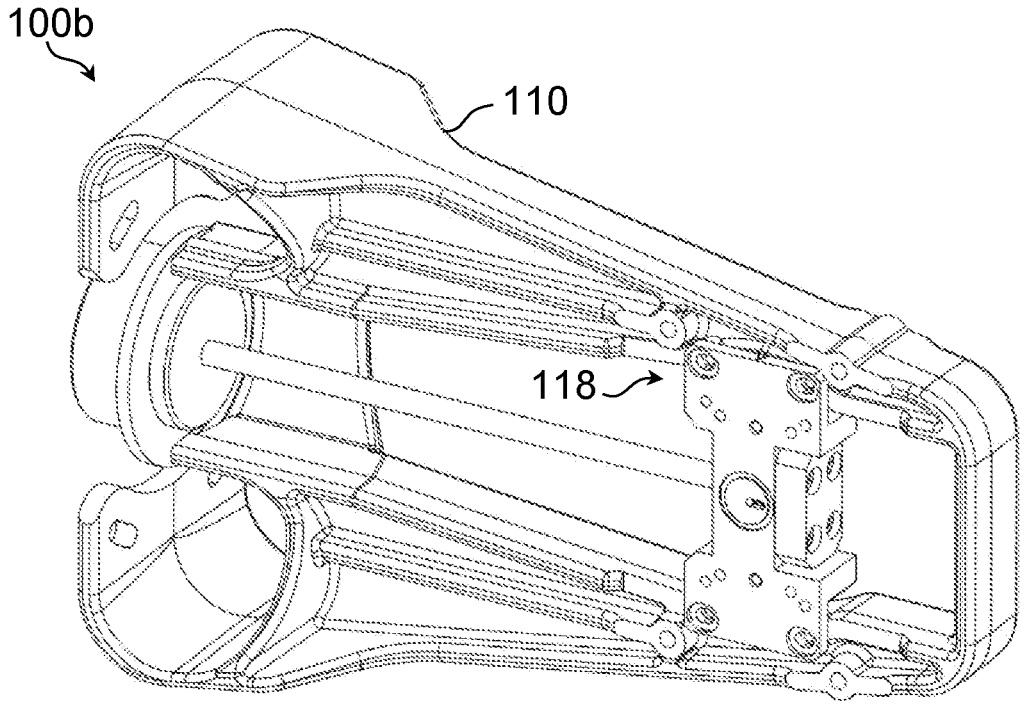
Figure 8C:
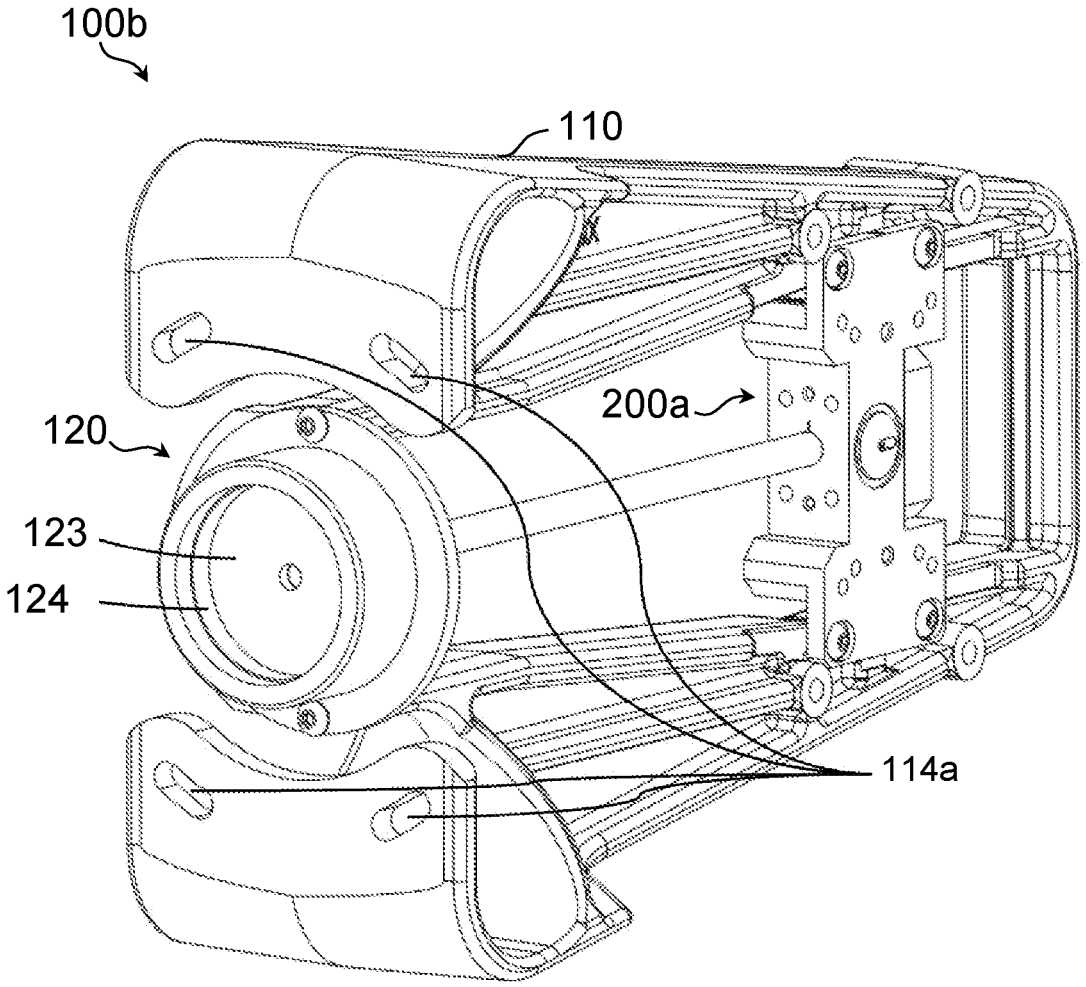

FIG. 8A schematically depicts a perspective view of an apparatus 100*b* according to further exemplary embodiments, FIG. 8B depicts a further perspective view of the apparatus 100*b*, and FIG. 8C schematically depicts a further perspective view of the apparatus 100*b*.

For mounting the OMT sub-assembly 200' to the frame 110 of the apparatus 100*b*, the OMT sub-assembly 200' is first moved radially inwards into the frame 110, cf. reference sign 1 of FIG. 8A. In this step, optionally, a coarse alignment of the antenna interface device 120, particularly of its front surface 122, with the supporting surface 112 may be made. According to further exemplary embodiments, said alignment may be facilitated by the surfaces 1202*a* (FIG. 3B), 1120 (FIG. 6C), which, according to further exemplary embodiments, may be complementary conical surfaces.

After this, the OMT sub-assembly 200' may be moved in an axial direction, cf. reference sign 2 of FIG. 8A, to bring the front surface 122 in tight surface contact with the supporting surface 112 of the frame, cf. FIG. 6C. Optional, a step of rotational alignment may follow such that screws 1206*a*, 1206*b* (FIG. 3B) may be provided in the holes 1204*a*, 1204*b* of the flange section 1202 and may be screwed into the threaded holes 112*a* (FIG. 6B) of the supporting surface 112, also cf. FIG. 8C. Once the flange section 1202 is secured at the supporting surface 112 of the frame 110 by means of the screws 1206*a*, 1206*b*, an axial alignment of the OMT sub-assembly 200' with respect to the frame 110 is completed, and the OMT 200*a* may be secured by means of screws to the receiving section 118 of the frame 110. This way, the complete OMT sub-assembly 200' is fixedly secured to the frame 110, cf. FIG. 8C. Advantageously, the abovementioned mounting procedure ensures that no mechanical stress is exerted to components of the OMT sub-assembly 200' (apart from the flange sections 1202, 202 for mounting, e.g., by torque-tightening the respective screws). Particularly, this way it is ensured that no external forces that may be present in the first axial end section 110*a* (FIG. 6A) of the frame 110 (e.g., due to mounting the apparatus to the antenna 300 via the fastening device 114) are transmitted to the second axial end section of the frame 110 and thus to the OMT 200*a*. In other words, a basically stress-free mounting of the OMT 200*a* at the frame may be obtained which e.g. enables a lightweight design of the OMT 200*a* that focuses on the RF signal processing functionality, but not on an increased mechanical stability as would e.g. be required by some conventional designs where external forces are transmitted to a conventional OMT.

According to further exemplary embodiments, said antenna interface device 120 (FIG. 8C) may comprises further surfaces for interfacing the antenna 300, e.g. a back surface 123 which may be pressed against a corresponding interface surface 304*c* (FIG. 9B) of an antenna interface section 304, and/or a concave surface 124 that may facilitate aligning and/or centering said antenna interface device 120 with said antenna interface section 304.

Figure 9A:
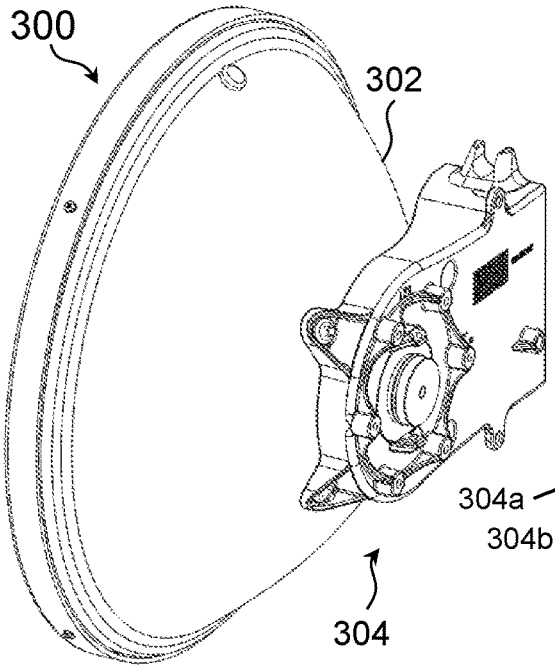
Figure 9B:
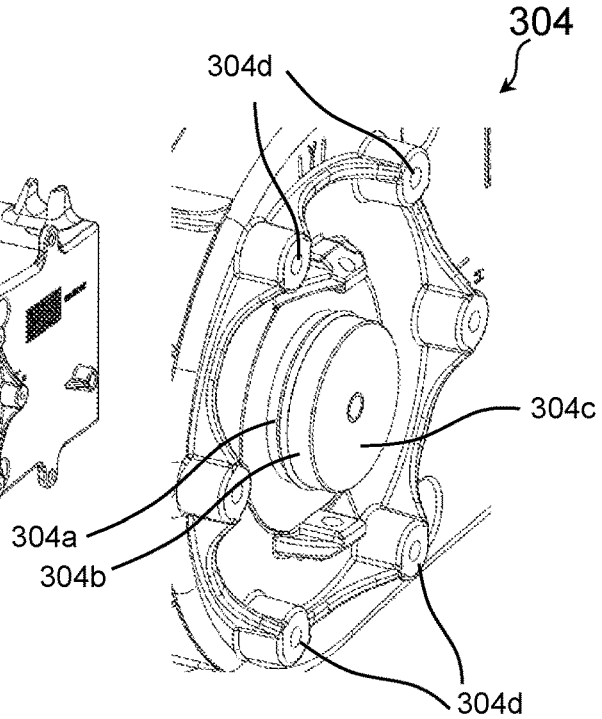

FIG. 9A schematically depicts a perspective view of an antenna 300 for use with the apparatus 100, 100*a*, 100*b* according to exemplary embodiments, and FIG. 9B schematically depicts a detail view of FIG. 9A. The antenna 300 comprises a parabolic reflector 302 and an antenna interface section 304 for attachment of the apparatus according to exemplary embodiments.

According to further exemplary embodiments, the antenna interface section 304 comprises a seal 304*a*, a cylindrical surface 304*b*, and a front surface 304*c* against which the antenna interface device 120 may be pressed when mounting said apparatus by means of the fastening device 114 (FIG. 1) at the antenna 300. As an example, back surface 123 (FIG. 8C) of the antenna interface device 120 may be pressed to the front surface 304*c* (FIG. 9B) of the antenna 300, thus avoiding leakage of RF signals exchanged between said antenna 300 and the antenna interface device 120. According to further exemplary embodiments, the surfaces 124, 304*b* may be used for aligning, particularly centering, elements 300, 120 with each other.

According to further exemplary embodiments, the antenna interface section 304 may comprise a plurality of threaded holes 304*d* for receiving screws which may be used to fasten the frame 110 with its fastening device 114 to the antenna 300.

Figure 10:
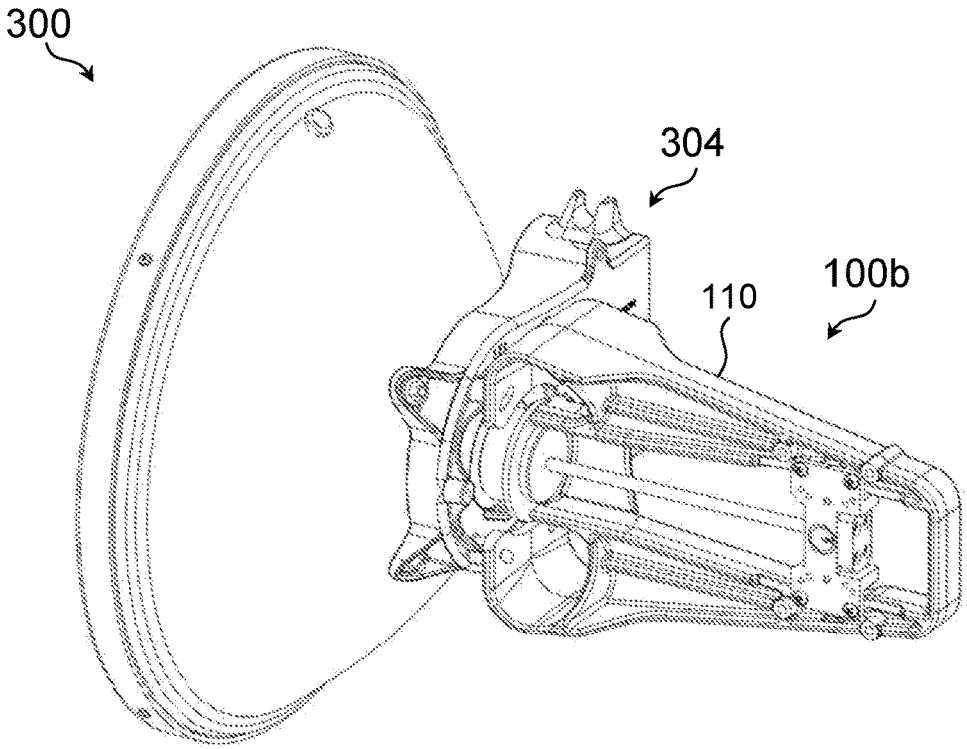

FIG. 10 schematically depicts a perspective view of an antenna 300 being attached to an apparatus 100*b* according to further exemplary embodiments, wherein the OMT sub-assembly is embedded within the frame 110. Note that the apparatus 100*b* is not yet fastened to the antenna, but may e.g. still be rotated relative to the antenna 300 to enable a fine tuning regarding polarization.

Figure 11:
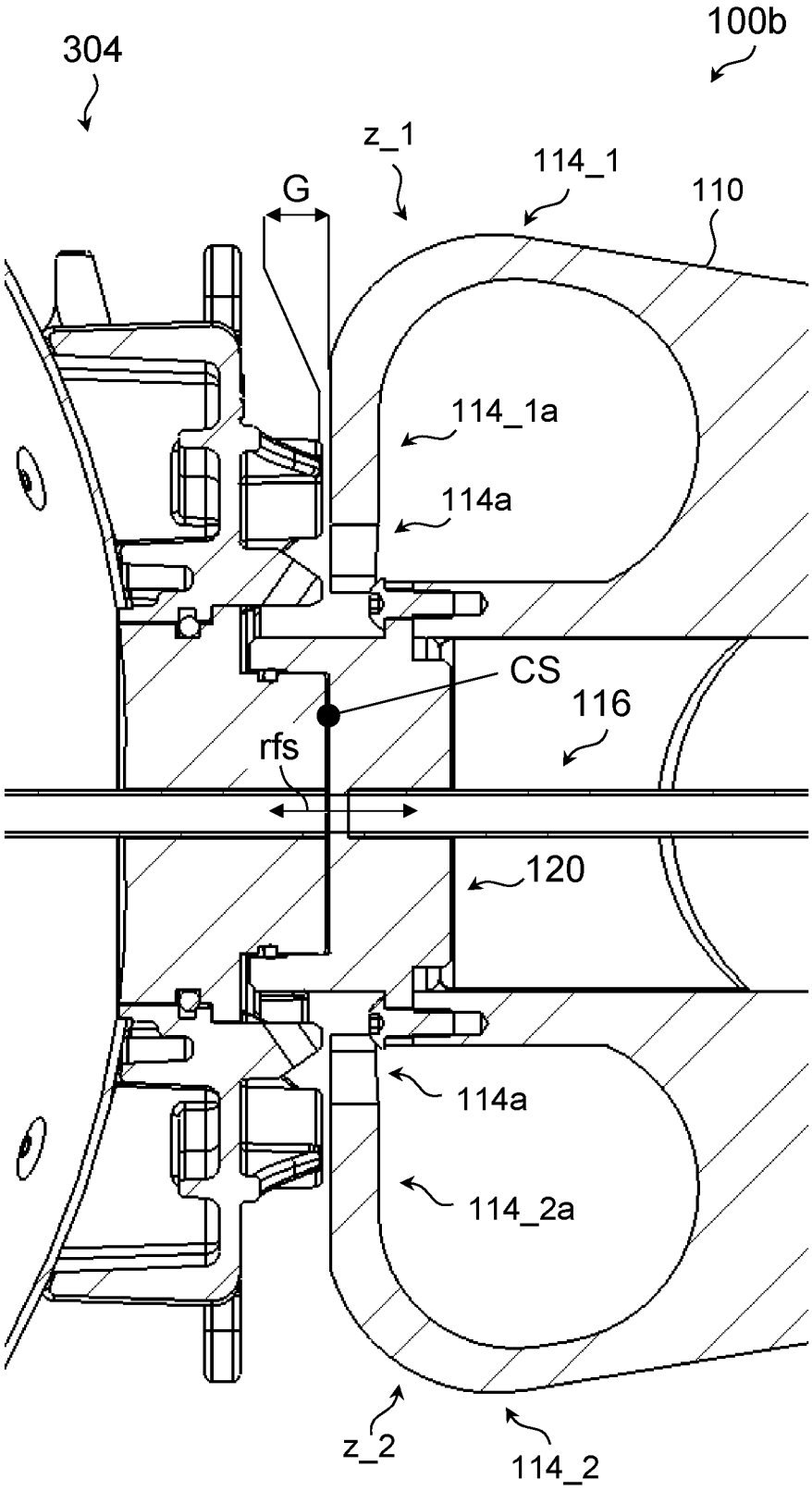

FIG. 11 schematically depicts a side view of a detail of FIG. 10 in partial cross-section. It can be seen that the surfaces 123, 304*c* make plane contact with each other thus defining a contact surface CS, which prevents leakage of RF signals rfs exchanged between the antenna 300 and the apparatus 100*b*. FIG. 11 also details how waveguide 116 may be inserted into the central opening 1201 (FIG. 3A) of the antenna interface device 120 according to further exemplary embodiments.

According to further exemplary embodiments, there is a gap G (FIG. 11) between the basically planar end sections 114_1*a*, 114_2*a* of the fastening device 114 and opposing counterparts of the antenna interface section 304, e.g. the regions of the antenna interface section 304 comprising said threaded holes 304*d* (FIG. 9B). The size of the gap G may e.g. be controlled by providing a corresponding geometry of the antenna interface device 120 and/or the antenna interface section 304.

Figure 12:
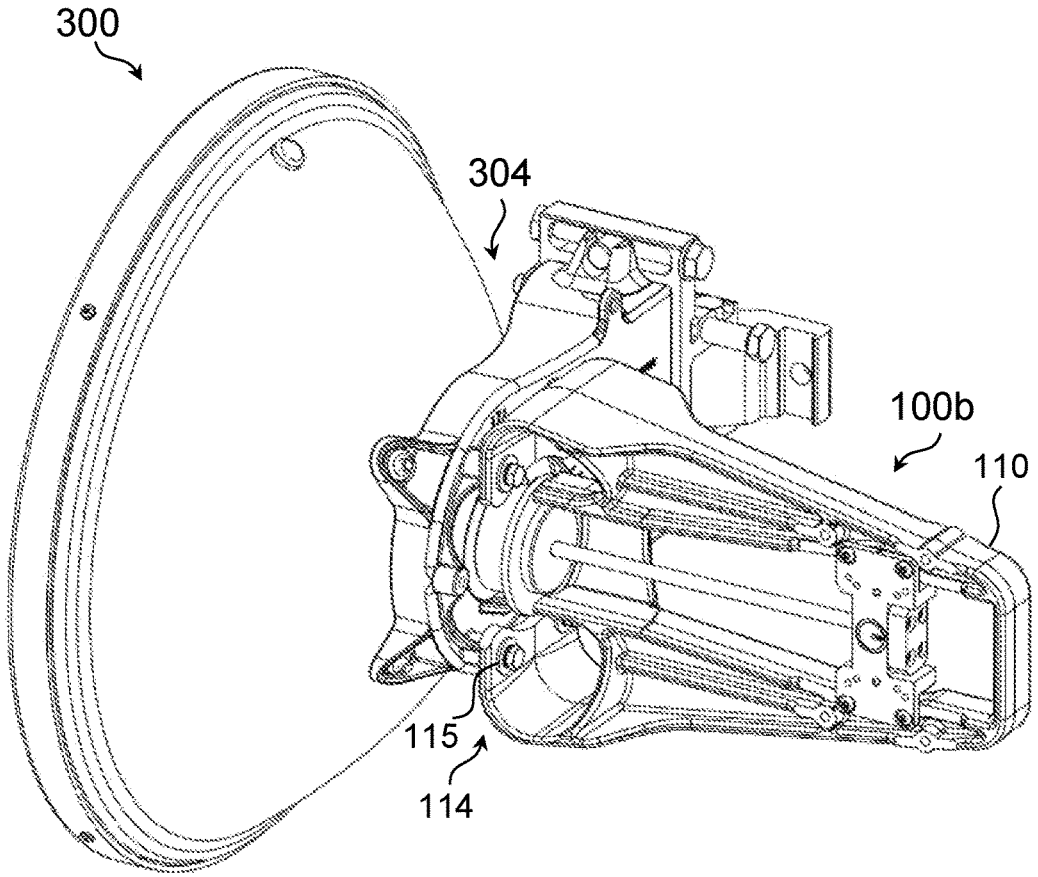

According to further exemplary embodiments, the fastening of the apparatus 100*b* on the antenna 300 is done with e.g. four screws (and/or any other attachment means enabling a releasable attachment). The screws are inserted through the oblong holes 114*a* of the fastening device 114 and may first be hand tightened in the threaded holes 304*d* of the antenna 300. As already mentioned above, the oblong holes 114*a* of the fastening device 114 allow a polarization adjustment of the apparatus 100*b* and its OMT, e.g. by rotating the apparatus 100*b* slightly towards the left or right relative to the antenna 300. The screws are then tightened, particularly torque tightened, e.g. with a torque wrench. During this final tightening, the gap G between the fastening sections 114_1, 114_2 and the antenna 300 is closed and there is contact between the components 114_1, 114_2, 304. Thereby, the elastically deformable zones z_1, z_2 are elastically deformed so that a contact pressure is generated between the surfaces CS, and the continuity of the waveguide is ensured between the antenna 300 and the OMT 200*a*. FIG. 12 exemplarily depicts the mounted state, wherein one of the four screws 115 is exemplarily referenced.

A specific benefit of the exemplary embodiments explained above with respect e.g. to FIG. 11 lies in the fact that during the torque tightening of the four screws 115 the gap G is "absorbed" by the elastic deformation of elastically deformable zones z_1, z_2 of the frame 110. In other words, during said torque tightening of the four screws 115, the size of the gap G is continuously reduced by the increasing elastic deformation of elastically deformable zones z_1, z_2. Advantageously, said deformation is basically limited to the first axial end section 110*a* (FIG. 6A) of the frame 110, so that particularly the second axial end section 110*b* and the OMT 200*a* arranged therein is not affected by this deformation and the related forces.

Figure 13:
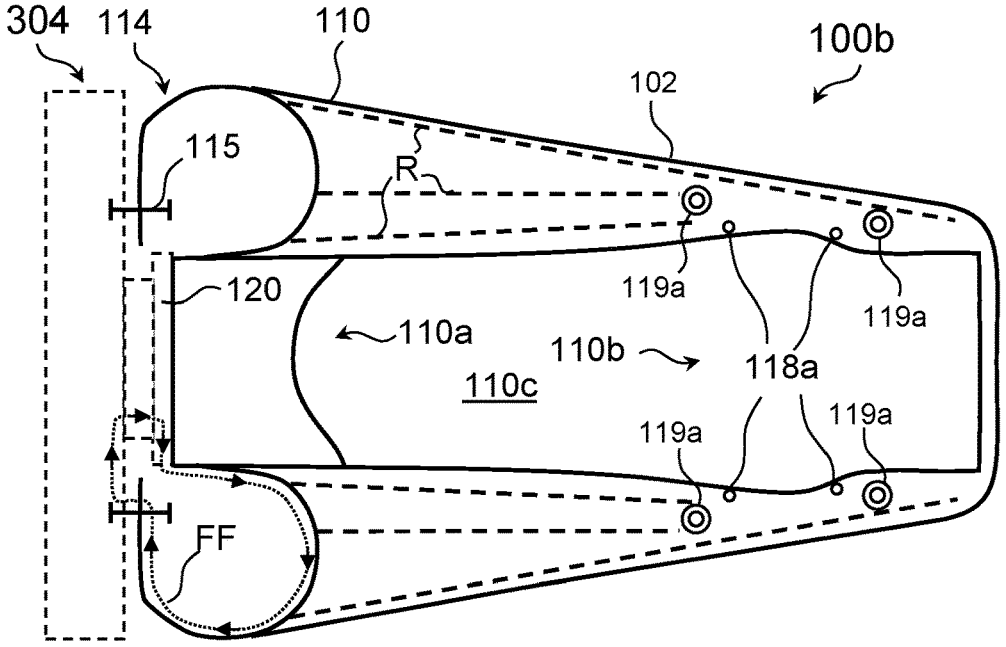

FIG. 13 depicts a simplified schematic side view of the frame 110 of the apparatus 100*b* according to further exemplary embodiments. In addition to the threaded holes 118*a* for mounting the OMT 200*a*, the frame 110 comprises holes or threaded holes 119*a* for mounting one or more radio devices ODU_1, ODU_2 (FIG. 1) to said frame 110. The holes 118*a*, 119*a* may be provided in the body 102 of the frame 110.

According to further exemplary embodiments, the body 102 may comprise one or more ribs R (cf. the dashed lines of FIG. 13) to increase a mechanical stability of the frame 110. Reference sign FF denotes a force flow which may result from fastening the apparatus 100*b* to the antenna by means of said screws 115. As can be seen, the force flow FF is advantageously located in the first axial end section 110*a* of the frame 110, so that the OMT 200*a*, which may be arranged in the second axial end section 110*b* of the frame 110 is not affected thereby. Particularly, the force flow FF does not go through the section 110*b* of the frame provided for receiving the OMT. Thus, no compressive stress is applied to an OMT mounted to the frame 110 when the apparatus 100*b* is fastened at the antenna 300.

In other words, according to further exemplary embodiments, said first axial end section 110*a* ("zone 1") of the frame 110 enables fastening of the apparatus 100*b* at the antenna 300 and to absorb the elastic deformation due to this fastening. According to further exemplary embodiments, the intermediate section 110*c* effects a spatial separation between "zone 1" 110*a* and a further zone defined by the second axial end section 110*b*. Advantageously, by providing one or more optional ribs R, the rigidity of the intermediate section 110*c* may be controlled such that forces and/or torques applied to zone 1 (section 110*a*) are not transmitted to the second axial end section 110*b* and thus to the OMT 200*a*. Particularly, this enables to keep compressive stress to the OMT 200*a* or the OMT sub-assembly 200' very low, so that it is negligible, as compared to conventional designs.

The invention claimed is:

1. An apparatus for attaching an orthogonal mode transducer, OMT, to an antenna, wherein said apparatus comprises a frame for receiving said OMT, and an antenna interface device for establishing a radio frequency, RF, signal connection between said OMT and said antenna, wherein said frame comprises a supporting surface for releasably attaching said antenna interface device to said frame and a fastening device for releasably attaching said frame to said antenna; and wherein said fastening device comprises at least two fastening sections, wherein at least one of said two fastening sections comprises an elastically deformable zone.

2. The apparatus according to claim 1, wherein at least one of said at least two fastening sections comprises a basically planar end section, wherein at least one oblong hole is provided in said basically planar end section.

3. The apparatus according to claim 1, wherein at least one of said two fastening sections comprises C-shape.

4. The apparatus according to claim 1, wherein a waveguide is provided for connecting said antenna interface device with said OMT.

5. The apparatus according to claim 4, wherein said waveguide is sealingly connected with said antenna interface device and said OMT, and said waveguide is mechanically connected with said antenna interface device and said OMT forming a monolithic OMT sub-assembly.

6. The apparatus according to claim 1, wherein the antenna interface device comprises a cylindrical body and a flange section extending radially from said body, wherein said flange section comprises a plurality of holes.

7. The apparatus according to claim 6, wherein said flange section comprises a convex cylindrical surface.

8. The apparatus according to claim 1, wherein the supporting surface comprises a plurality of threaded holes.

9. The apparatus according to claim 1, wherein said OMT comprises at least one flange section for releasably attaching said OMT to said frame, wherein said at least one flange section comprises at least one oblong hole.

10. The apparatus according to claim 1, wherein said frame comprises a receiving section for releasably attaching said OMT to said frame, wherein preferably said receiving section comprises a plurality of threaded holes.

11. The apparatus according to claim 10, wherein said supporting surface is arranged in a first axial end section of said frame, and wherein said receiving section is arranged in a second axial end section of said frame.

12. A method of providing an apparatus for attaching an orthogonal mode transducer, OMT, to an antenna, wherein said apparatus comprises a frame for receiving said OMT, and an antenna interface device for establishing a radio frequency, RF, signal connection between said OMT and said antenna, wherein said frame comprises a supporting surface for releasably attaching said antenna interface device to said frame and a fastening device for releasably attaching said frame to said antenna, said method comprising:

providing said antenna interface device, releasably attaching said antenna interface device to said frame, and releasably attaching said OMT to said antenna interface device, and wherein said fastening device comprises at least two fastening sections, wherein at least one of said two fastening sections comprises an elastically deformable zone.

13. The method according to claim 12, further comprising: providing a monolithic OMT sub-assembly comprising said antenna interface device, said OMT, and optionally a waveguide connecting said antenna interface device with said OMT, attaching said antenna interface device to said supporting surface of said frame, and attaching said OMT to said frame.

14. An apparatus for attaching an orthogonal mode transducer, OMT, to an antenna, wherein said apparatus comprises a frame for receiving said OMT, and an antenna interface device for establishing a radio frequency, RF, signal connection between said OMT and said antenna, wherein said frame comprises a supporting surface for releasably attaching said antenna interface device to said frame and a receiving section for releasably attaching said OMT to said frame, wherein said receiving section comprises a plurality of threaded holes; and wherein said supporting surface is arranged in a first axial end section of said frame, and said receiving section is arranged in a second axial end section of said frame.

* * * * *